US006615903B2

(12) United States Patent
Lindgren

(10) Patent No.: US 6,615,903 B2
(45) Date of Patent: Sep. 9, 2003

(54) METHOD FOR DETECTING AN AT LEAST PARTLY BULGING PORTION OF AN ELONGATED MATERIAL

(75) Inventor: Håkan Lindgren, Göteborg (SE)

(73) Assignee: Aktiebolaget SKF, Göteborg (SE)

( * ) Notice: Subject to any disclaimer, the term of this patent is extended or adjusted under 35 U.S.C. 154(b) by 0 days.

(21) Appl. No.: 10/151,822

(22) Filed: May 22, 2002

(65) Prior Publication Data

US 2002/0185252 A1 Dec. 12, 2002

(30) Foreign Application Priority Data

May 23, 2001 (SE) ..... 0101836

(51) Int. Cl.[7] ..... B22D 11/128; B22D 11/20
(52) U.S. Cl. ..... 164/454; 164/413; 164/151
(58) Field of Search ..... 164/454, 151, 164/151.2, 413

(56) References Cited

U.S. PATENT DOCUMENTS 4,056,140 A * 11/1977 Ives et al. ..... 164/454
6,470,957 B1 * 10/2002 Ashburn ..... 164/454

* cited by examiner

*Primary Examiner*—Kuang Y. Lin
(74) *Attorney, Agent, or Firm*—Burns, Doane, Swecker & Mathis, LLP

(57) ABSTRACT

A method for detecting an at least partly bulging portion of an elongated material produced in a continuous casting machine in which the machine has a plurality of rollers arranged in two tracks converging towards each other to transport the material, with the rollers being divided into at least two roller portions each rotatably mounted in supporting members. The method involves measuring the radial load exerted by the material on each supporting member of the roller portions of a roller, comparing the radial load values of the supporting members arranged in the ends of roller portions facing away from each other with those of the supporting members arranged in the ends of the roller portions facing each other to ascertain a divergence, and establishing that an at least partly bulging portion of the material exists where the divergence exceeds a predetermined value.

13 Claims, 2 Drawing Sheets

METHOD FOR DETECTING AN AT LEAST PARTLY BULGING PORTION OF AN ELONGATED MATERIAL

This application is based on and claims priority under 35 U.S.C. §119 with respect to Swedish Application No. 0101836-5 filed on May 23, 2001, the entire content of which is incorporated herein by reference.

FIELD OF THE INVENTION

This invention generally relates to continuous casting machine. More particularly, the invention pertains to a method for detecting an at least partly bulging portion of an elongated material produced in a continuous casting machine.

BACKGROUND OF THE INVENTION

A continuous casting machine produces steel material from molten steel. This steel material can, for example, be used as a starting material in rolling processes for producing sheet metal used in, for example, vehicles.

In continuous casting machines, molten steel flows from a ladle and down in a tundish from which it is transported further down into a mold. In the mold, which is water-cooled, the slab of continuous cast material begins to form a solid shell. Then, the slab is continuously transported in between two curved tracks (a first track and a second track) by a large number of rollers arranged in segments which continue to shape and cool the slab to the final thickness of the steel material. At the end of the tracks, the material is cut into suitable pieces. The cooling can be achieved by spraying water onto the slab and the rollers.

The rollers of the continuous casting machine are mounted with their axes substantially perpendicular to the longitudinal extension of the curved tracks. To lead and support the slab of continuous cast material, the rollers are arranged in pairs, each comprising a roller from the first track and a roller from the second track.

Further, the rollers are rotatably mounted in supporting members at each end of the rollers and due to the length of the rollers, and the load on the rollers, the rollers are generally split into at least two roller portions. These roller portions are either independently mounted in supporting members or non-rotatably provided on a common shaft, with the shaft being rotatably mounted in supporting members. The supporting members can for instance be rolling bearings or sliding bearings with corresponding bearing housings.

Considering the solidification process of the material being cast, the process starts at the slab surface and a thin layer of substantially solidified material is formed around the liquid core. Further cooling results in the side edges of the slab slowly being solidified, while the center of the slab is still substantially liquid except for the surface layer. Yet further, the core of liquid material will slowly decrease and finally the core is entirely solidified. During the solidification, when the material is cooled down, the material will generally shrink as hot metal has a larger volume than cold metal.

This shrinkage can result in a problem in that one of the conditions that must be fulfilled to obtain a cast material of high quality and relatively even thickness is that the rollers of the first track and the rollers of the second track must be able to correctly support the slab and control the thickness of the slab throughout the entire process. Thus, the mutual distance between the two tracks must correspond to the desired thickness of the slab at every point during the process. Such a set up of the machine is generally quite difficult to obtain.

However, it can also be established that the two tracks converge towards each other. This means that in the upper portion of the machine where the slab is very hot, the mutual distance between the rollers of the first and second track is larger than at a location further down in the machine where the slab has been cooled off, as the slab in that position has shrunk somewhat.

If the mutual distance between the tracks is not correct, i.e. if the tracks are not converging towards each other in an accurate way, the thickness of the material being cast will not be uniform. Considering a pair of rollers where the mutual distance between the rollers is too large, the cross-sectional profile of the material being cast will at least partly bulge outwards, i.e. will have a convex profile where the middle portion of the slab will be thicker than the side edges. This is due to the fact that the sides have started to solidify, while the centre of the slab is still liquid. If there is no pressure from the rollers, the inner pressure of the material flowing down from the mold will force more material into the liquid centre of the slab and the middle portion of the slab will therefore expand. The deformation can lead to depressions near the slab corners, which can lead to longitudinal corner cracks.

On the other hand, when the mutual distance between the rollers is too small, the material will at least partly bulge inwards as it is squeezed and rolled between the rollers. The roll motion forces some of the material in the molten core to flow back against the transportation direction. Hence, there will be too little material left in the middle of the slab when it is cooled off and the slab profile will be concave. Furthermore, this roll motion exerts dynamic forces to the rollers and the supporting members, which together with the load of the slab and the weight of the roller, can lead to extremely high loads in the supporting members, which in turn can lead to failures.

From the discussion above, it can be seen that it would be desirable to be able to detect an incorrect mutual distance between the tracks of rollers so that a correct adjustment of the rollers can be made.

SUMMARY OF THE INVENTION

Hereinafter, an incorrect mutual distance between the first track and the second track is denoted as an erroneous convergence between the tracks. A method according to one aspect of the present invention involves a method for detecting an at least partly bulging portion of an elongated material produced in a continuous casting machine and involves measuring the radial load exerted by the material on each supporting member of the roller portions of a roller, comparing the radial load values of the supporting members arranged in the ends of two adjacent roller portions facing away from each other with those of the supporting members arranged in the ends of the two adjacent roller portions facing each other, and establishing the presence of an at least partly bulging portion of the elongated material where the divergence between the load values of the supporting members arranged in the ends of the two adjacent roller portions facing away from each other and the supporting members arranged in the ends of the two adjacent roller portions facing each other is exceeding a predetermined value.

If the load values of the supporting members arranged in the ends of the two adjacent roller portions facing away from each other are higher than the load values of the supporting members arranged in the ends of the two adjacent roller portions facing each other, it can be established that the mutual distance between the tracks is too small. If instead the load values of the supporting members arranged in the ends of the two adjacent roller portions facing away from each other are lower than the load values of the supporting members arranged in the ends of the two adjacent roller portions facing each other, it can be established that the mutual distance between the tracks is too large.

Thus, if the load values of the supporting members arranged in the ends of the two adjacent roller portions facing away from each other are equal or substantially equal to the load values of the supporting members arranged in the ends of the two adjacent roller portions facing each other, it can be determined that an appropriate mutual distance exists between the tracks.

According to another aspect, a method for detecting an at least partly bulging portion of an elongated material produced in a continuous casting machine comprises transporting the elongated material between two tracks converging towards each other in the continuous casting machine, with each track comprising a plurality of rollers arranged substantially perpendicular to longitudinal extensions of the tracks, and at least some of the rollers being divided into at least two axially adjacent roller portions, with each end of each roller portion being rotatably mounted in a supporting member. The method also comprises measuring a radial load exerted by the material on each supporting member of the roller portions of one at least one of the rollers, comparing the radial loads of the supporting members at the ends of two adjacent roller portions facing away from each other with the radial loads of the supporting members at the ends of the two adjacent roller portions facing each other, and determining that an at least partly bulging portion exists in the elongated material when a divergence between the radial loads of the supporting members arranged in the ends of the two adjacent roller portions facing away from each other and the supporting members arranged in the ends of the two adjacent roller portions facing each other exceeds a predetermined value.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
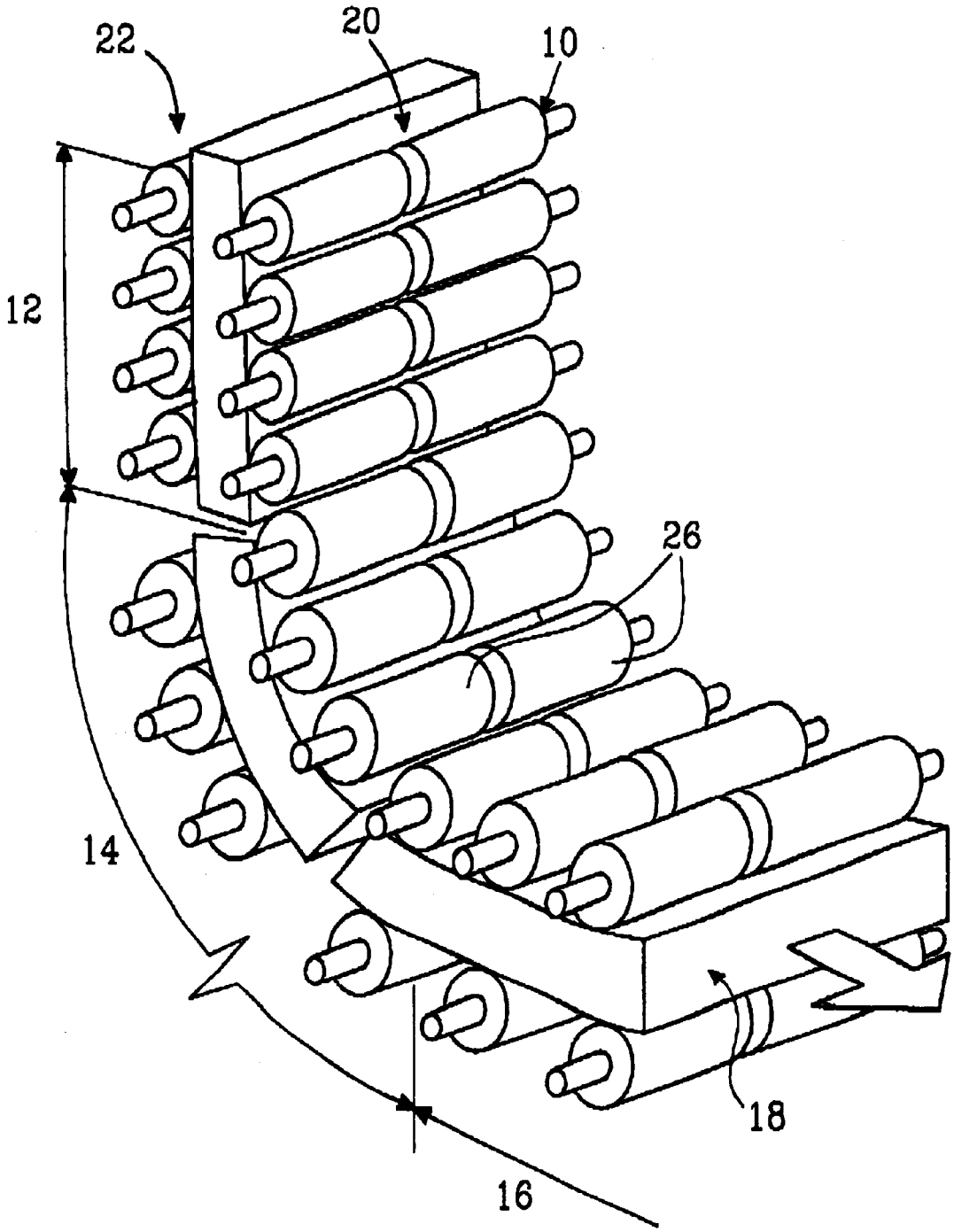
FIG. 1 is a perspective view a set of rollers in a continuous casting machine.

FIG. 1 schematically illustrates two rows of rollers 10 in a portion or section of a continuous casting machine having a top segment 12, an inside cooling chamber 14 and an outside cooling chamber 16. The arranged pairs of rollers 10 lead and support the slab 18 of a continuous length of continuous cast material produced by the continuous casting machine. In the top segment 12, the slab 18 has a more or less liquid core 19 (FIG. 2), but during feeding under continuous movement in the direction shown by the arrow, the slab 18 will solidify as it is cooled off by for instance water that is sprayed onto the slab 18 and the rollers 10.

Figure 3:
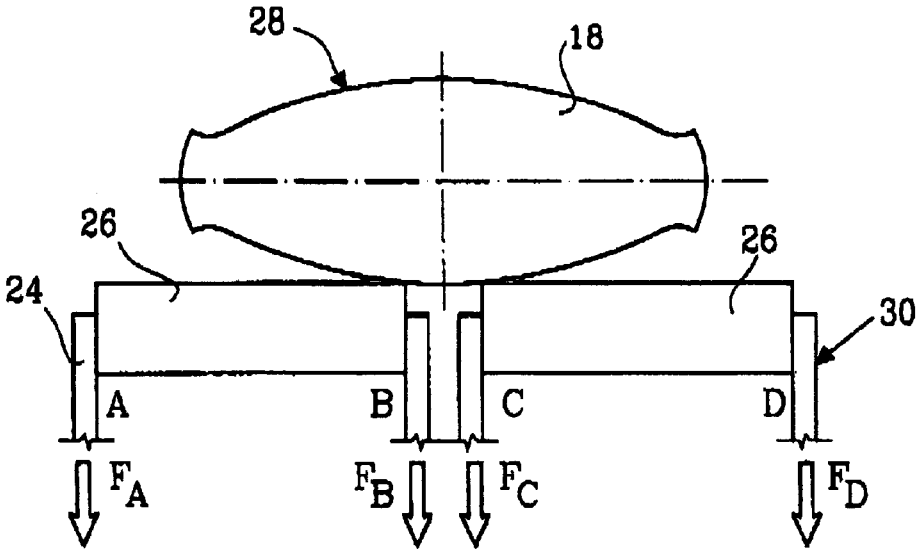
FIG. 3 is a schematic view of the slab bulging outwards due to an excessively large mutual distance between the two tracks.

The rollers 10 are arranged in two tracks, a first track 20 and a second track 22. The rollers 10 are each mounted with their axes substantially perpendicular to the longitudinal extension or longitudinal extent of the first track 20 and second track 22. In the tracks 20, 22, the rollers 10 are rotatably mounted in supporting members 24 (FIG. 3) at each end of each roller 10. The supporting members 24 are schematically illustrated in FIG. 3 and can be in the form of a rolling bearing or a sliding bearing.

Generally, the rollers 10 are split or divided into at least two roller portions 26. These roller portions 26 are positioned axially adjacent one another as shown in FIG. 1 and are either independently mounted in supporting members 24 or are non-rotatably provided on a common shaft, which shaft is mounted in the supporting members 24. For instance, the supporting members 24 can be rolling bearings or sliding bearings with corresponding bearing housings.

Figure 2:
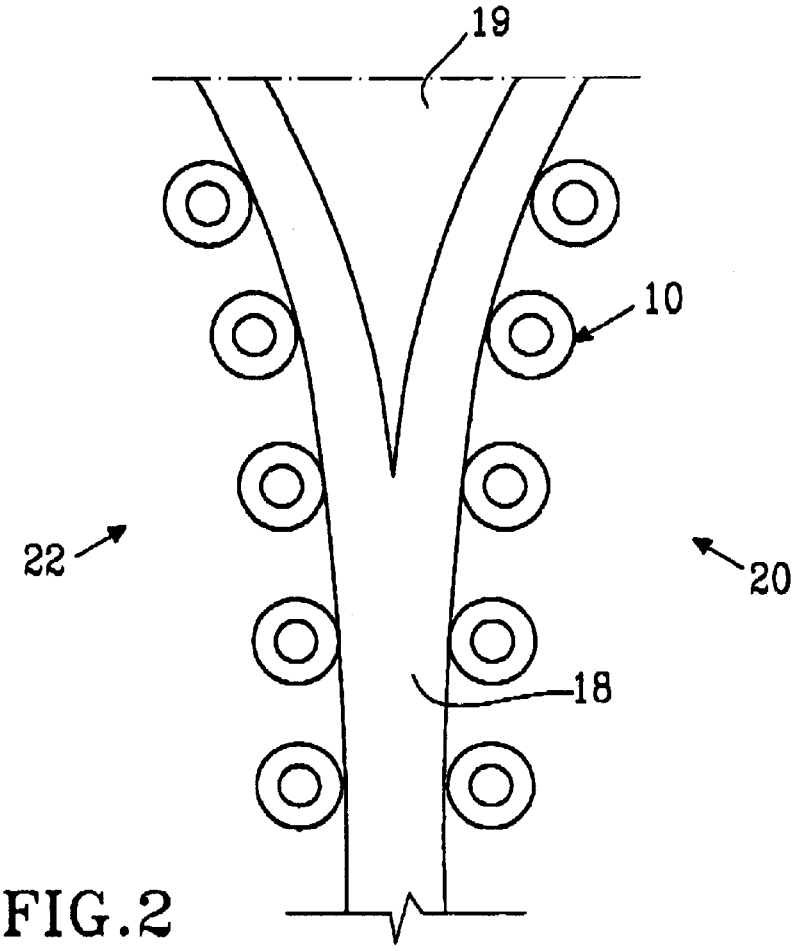
FIG. 2 is a schematic side view of first and second tracks in a continuous casting machine in which the first track and the second track converge towards each other.

As mentioned above, hot molten metal has a larger volume than cold solidified metal, and so the thickness of the slab 18 will slowly decrease due to shrinkage when the liquid core 19 of the slab 18 is cooled off. Therefore, it is preferred that the first and second tracks 20, 22 be configured and arranged to slowly converge towards each other as shown in FIG. 2 so that the mutual distance between the first and second tracks 20, 22 at every pair of rollers 10 corresponds to the desired thickness of the slab 18 at that point. The rollers 10 should then be able to correctly support the slab 18, and the thickness of the material produced will have a substantially even thickness.

As previously mentioned, the slab 18 will start bulging if the convergence between the two tracks 20, 22 is erroneous or incorrect. If the mutual distance between the first and second tracks 20, 22 is too small, the slab 18 will at least partly bulge inwards and the slab 18 will have a concave profile. This is due to the rollers 10 squeezing the slab 18 together so much that some of the liquid core 19 in the center of the slab 18 is forced backwards in the process. As a result, the center of the slab 18 will have less material than the sides and thus, when the rest of the core 19 of the slab 18 solidifies and therefore shrinks, the material thickness in the center of the slab 18 will be less than at the sides.

On the other hand, if the mutual distance between the tracks 20, 22 is too large, the slab 18 will at least partly bulge outwards so that the slab 18 will have a convex profile 28. The middle portion of the slab 18 will be thicker than the side edges as the sides have started to solidify while the center of the slab 18 is still liquid. The inner pressure of the material flowing down from the mold will thus force more material into the slab 18. The middle portion of the slab 18 will therefore expand.

These sorts of deformations of the material being cast can be detected with the method of the present invention. Generally speaking, the method involves measuring the radial load exerted by the material on each supporting member of the roller portions of a roller, comparing the radial load values of the supporting members arranged in the ends of two adjacent roller portions facing away from each other with those of the supporting members arranged in the ends of the two adjacent roller portions facing each other, and establishing the presence of an at least partly bulging portion of the elongated material where the divergence between the load values of the supporting members arranged in the ends of the two adjacent roller portions facing away from each other and the supporting members arranged in the ends of the two adjacent roller portions facing each other exceeds a predetermined value.

If the load values of the supporting members arranged in the ends of the two adjacent roller portions facing away from each other are higher than the load values of the supporting members arranged in the ends of the two adjacent roller portions facing each other, it can be established that the mutual distance between the first and second tracks is too small. On the other hand, if the load values of the supporting members arranged in the ends of the two adjacent roller portions facing away from each other are lower than the load values of the supporting members arranged in the ends of the two adjacent roller portions facing each other, it can be established that the mutual distance between the tracks is too large.

Referring to FIG. 3, an example of the method according to the present invention will be described in the context of an erroneous convergence between the first and second tracks 20, 22 leading to a convex profile 28 of the slab 18. This example explains the basic principle of the invention and only the second track 22 of rollers 10 in a continuous casting machine will be considered and described. In addition, the rollers 10 are split into portions 26 which are independently mounted in supporting members 24.

To detect the convex profile 28 of the slab 18, the radial load (denoted F) exerted by the material being cast on each supporting member 24 of the roller portions 26 of a roller 10 is measured. According to the method, a measuring device 30 is provided in each supporting member 24 of each roller portion 26. This measuring device 30 is adapted to measure the radial load value F acting in the supporting member. Load measuring devices which can be used are known.

In this example, the radial load values F of the supporting members 24 that are arranged in the ends of the two roller portions 26 facing away from each other are measured. These two ends are denoted A and D, and the loads on the supporting members are denoted $F_A$ and $F_D$. Also, the radial load values F of the supporting members 24 arranged in the ends of the two roller portions 26 facing each other are measured. These two ends are denoted B and C, and the loads on the supporting members are denoted $F_B$ and $F_C$. When all such radial load values F of a roller 10 are determined and collected, the radial load values F of the supporting members 24 arranged in the ends A and D of the two roller portions 26 facing away from each other are compared with the radial load values F of the supporting members 24 arranged in the ends B and C of the two roller portions 26 facing each other. That is, the values of the loads $F_A$ and $F_D$ are compared with the values of the loads $F_B$ and $F_C$.

In the FIG. 3 illustration, because the slab 18 has a convex profile 28, the middle portion of the slab will be bulging outwards, and the slab 18 will loose contact with the roller 10 at its side ends. The load of the slab 18 will therefore be concentrated at the middle portion of the roller 10, i.e. at the supporting members 24 in the ends B and C of the roller portions 26 facing each other. Consequently, the radial load values F of the supporting members arranged in the ends B and C of the roller portions 26 facing each other are higher than those of the supporting members 24 arranged in the ends A and D of the two roller portions 26 facing away from each other.

Thus, in this example, there will be a divergence between the values $F_A+F_D$ and $F_B+F_C$, which divergence exceeds a predetermined value which is a maximum allowable value before the bulging of the slab 18 is considered to be too serious or excessive.

With such a divergence detected, it can then be established that there exists an erroneous convergence between the tracks 20, 22. Further, because the load values of the supporting members arranged in the ends of the two adjacent roller portions 26 facing away from each other are lower than the load values of the supporting members arranged in the ends of the two adjacent roller portions 26 facing each other, it can be established that the mutual distance between the tracks 20, 22 is too large or excessive.

The rollers 10 can then be displaced or moved so that the mutual distance between the two tracks 20, 22 is adjusted to the correct mutual distance. In the case of a convex profile 28 of the slab 18, as in the described example, the mutual distance between the first and second tracks 20, 22 has to be reduced. If instead the slab profile is concave, the mutual distance between the tracks 20, 22 is too small and has to be increased.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. Method for detecting an at least partly bulging portion of an elongated material produced in a continuous casting machine, comprising:

transporting the elongated material between two tracks converging towards each other in the continuous casting machine, each track comprising a plurality of rollers arranged substantially perpendicular to longitudinal extensions of the tracks, at least some of the rollers being divided into at least two axially adjacent roller portions, with each end of each roller portion being rotatably mounted in a supporting member;

measuring a radial load exerted by the material on each supporting member of the roller portions of at least one of the rollers;

comparing the radial loads of the supporting members at the ends of two adjacent roller portions facing away from each other with the radial loads of the supporting members at the ends of the two adjacent roller portions facing each other; and determining that an at least partly bulging portion exists in the elongated material when a divergence between the radial loads of the supporting members arranged in the ends of the two adjacent roller portions facing away from each other and the supporting members arranged in the ends of the two adjacent roller portions facing each other exceeds a predetermined value.

2. Method according to claim 1, including determining that a mutual distance between the two tracks is too small when the radial loads of the supporting members arranged in the ends of the two adjacent roller portions facing away from each other are higher than the radial loads of the supporting members arranged in the ends of the two adjacent roller portions facing each other.

3. Method according to claim 1, including determining that a mutual distance between the tracks is too large when the radial loads of the supporting members arranged in the ends of the two adjacent roller portions facing away from each other are lower than the loads of the supporting members arranged in the ends of the two adjacent roller portions facing each other.

4. Method according to claim 1, including increasing a mutual distance between the two tracks when the radial loads of the supporting members arranged in the ends of the two adjacent roller portions facing away from each other are higher than the radial loads of the supporting members arranged in the ends of the two adjacent roller portions facing each other.

5. Method according to claim 1, including decreasing a mutual distance between the tracks when the radial loads of the supporting members arranged in the ends of the two adjacent roller portions facing away from each other are lower than the loads of the supporting members arranged in the ends of the two adjacent roller portions facing each other.

6. Method for detecting an at least partly bulging portion of an elongated material produced in a continuous casting machine, the continuous casting machine comprising a plurality of rollers arranged in two tracks with the rollers being arranged substantially perpendicular to longitudinal extensions of the two tracks, the tracks converging towards each other, and the rollers being divided in at least two adjacent roller portions each rotatably mounted in supporting members and arranged for transporting the elongated material, the method comprising:

measuring a radial load value exerted by the material on each supporting member of the roller portions of at least one of the rollers;

comparing the radial load values of the supporting members arranged in ends of two adjacent roller portions facing away from each other with the radial load values of the supporting members arranged in ends of the two adjacent roller portions facing each other; and establishing a presence of an at least partly bulging portion of the elongated material where a divergence between the radial load values of the supporting members arranged in the ends of the two adjacent roller portions facing away from each other and the supporting members arranged in the ends of the two adjacent roller portions facing each other exceeds a predetermined value.

7. Method according to claim 6, including establishing that a mutual distance between the tracks is too small when the radial load values of the supporting members arranged in the ends of the two adjacent roller portions facing away from each other are higher than the radial load values of the supporting members arranged in the ends of the two adjacent roller portions facing each other.

8. Method according to claim 6, including establishing that a mutual distance between the tracks is too large when the radial load values of the supporting members arranged in the ends of the two adjacent roller portions facing away from each other are lower than the load values of the supporting members arranged in the ends of the two adjacent roller portions facing each other.

9. Method according to claim 6, wherein the supporting member is a rolling bearing.

10. Method according to claim 6, wherein the supporting member is a sliding bearing.

11. Method according to claim 6, wherein the supporting member comprises a measuring device.

12. Method according to claim 6, including increasing a mutual distance between the two tracks when the radial load values of the supporting members arranged in the ends of the two adjacent roller portions facing away from each other are higher than the radial load values of the supporting members arranged in the ends of the two adjacent roller portions facing each other.

13. Method according to claim 6, including decreasing a mutual distance between the tracks when the radial load values of the supporting members arranged in the ends of the two adjacent roller portions facing away from each other are lower than the load values of the supporting members arranged in the ends of the two adjacent roller portions facing each other.

* * * * *